US008231109B2

(12) United States Patent
Peng

(10) Patent No.: US 8,231,109 B2
(45) Date of Patent: Jul. 31, 2012

(54) REEL STRUCTURE FOR MARINE FABRIC TAPE

(76) Inventor: I-Sin Peng, Taichung (TW)

( * ) Notice: Subject to any disclaimer, the term of this patent is extended or adjusted under 35 U.S.C. 154(b) by 345 days.

(21) Appl. No.: 12/578,282

(22) Filed: Oct. 13, 2009

(65) Prior Publication Data

US 2011/0084159 A1 Apr. 14, 2011

(51) Int. Cl.
*B21F 9/00* (2006.01)

(52) U.S. Cl. ..... 254/223; 254/214; 254/221; 242/388.5; 242/532.6; 242/613

(58) Field of Classification Search ..... 254/214, 254/219, 221, 222, 223, 241, 342; 242/388, 242/388.1, 388.5, 402, 407, 532.6, 613
See application file for complete search history.

(56) References Cited

U.S. PATENT DOCUMENTS 222,013 A * 11/1879 Clark et al. ..... 254/219
1,108,981 A * 9/1914 Eoff ..... 254/219
1,435,059 A * 11/1922 Franzen ..... 254/263
2,129,569 A * 9/1938 De Lay ..... 294/132
3,939,729 A * 2/1976 Brockelsby ..... 74/575
4,456,227 A * 6/1984 Notenboom ..... 254/350
4,566,674 A * 1/1986 Ebey et al. ..... 254/345
5,611,520 A * 3/1997 Soderstrom ..... 254/218
6,068,210 A * 5/2000 Risa ..... 242/532.5
6,092,791 A * 7/2000 Kingery ..... 254/371
6,116,580 A * 9/2000 Hull ..... 254/357
6,123,286 A * 9/2000 Garcia et al. ..... 242/587.2
6,332,586 B1 * 12/2001 Risa et al. ..... 242/530.2
6,431,525 B1 * 8/2002 Roll ..... 254/357
7,458,563 B1 * 12/2008 Liu ..... 254/334
7,484,713 B1 * 2/2009 Young ..... 254/342

* cited by examiner

*Primary Examiner* — Emmanuel M Marcelo
(74) *Attorney, Agent, or Firm* — Jackson IPG PLLC; Demian K. Jackson

(57) ABSTRACT

A reel structure for a marine fabric tape includes a reel device pivoted to an engaging seat. When a handle of a windlass is turned, a flat rod will be driven to rotate a gear shaft which then drives a gear disc to rotate. Because a head portion is positioned in an axle shaft, a fabric tape is rolled up along with the axle shaft to form a circular shape, providing an even applied force for rolling up the fabric tape.

1 Claim, 7 Drawing Sheets

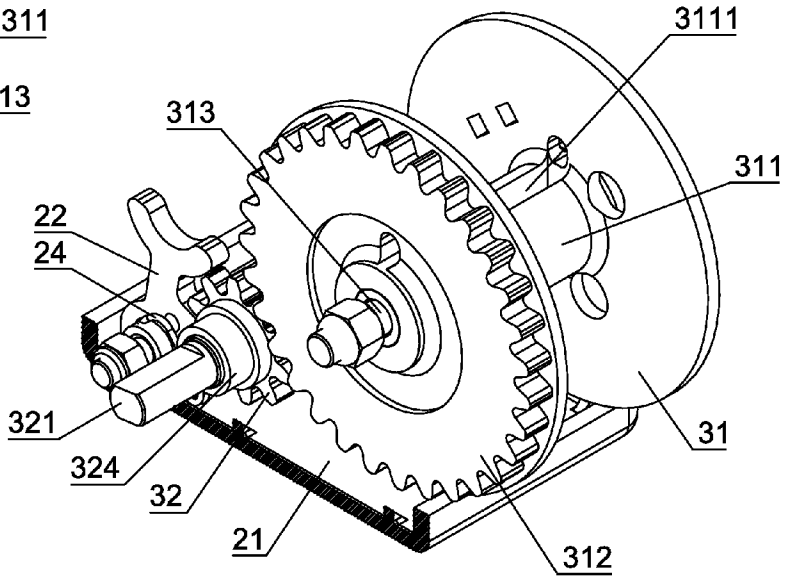
Fig. 3-B
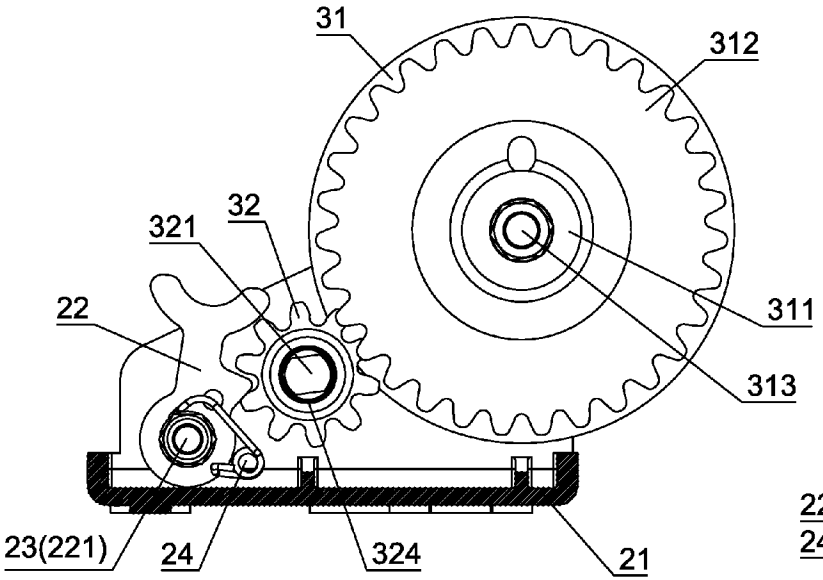
Fig. 3-A

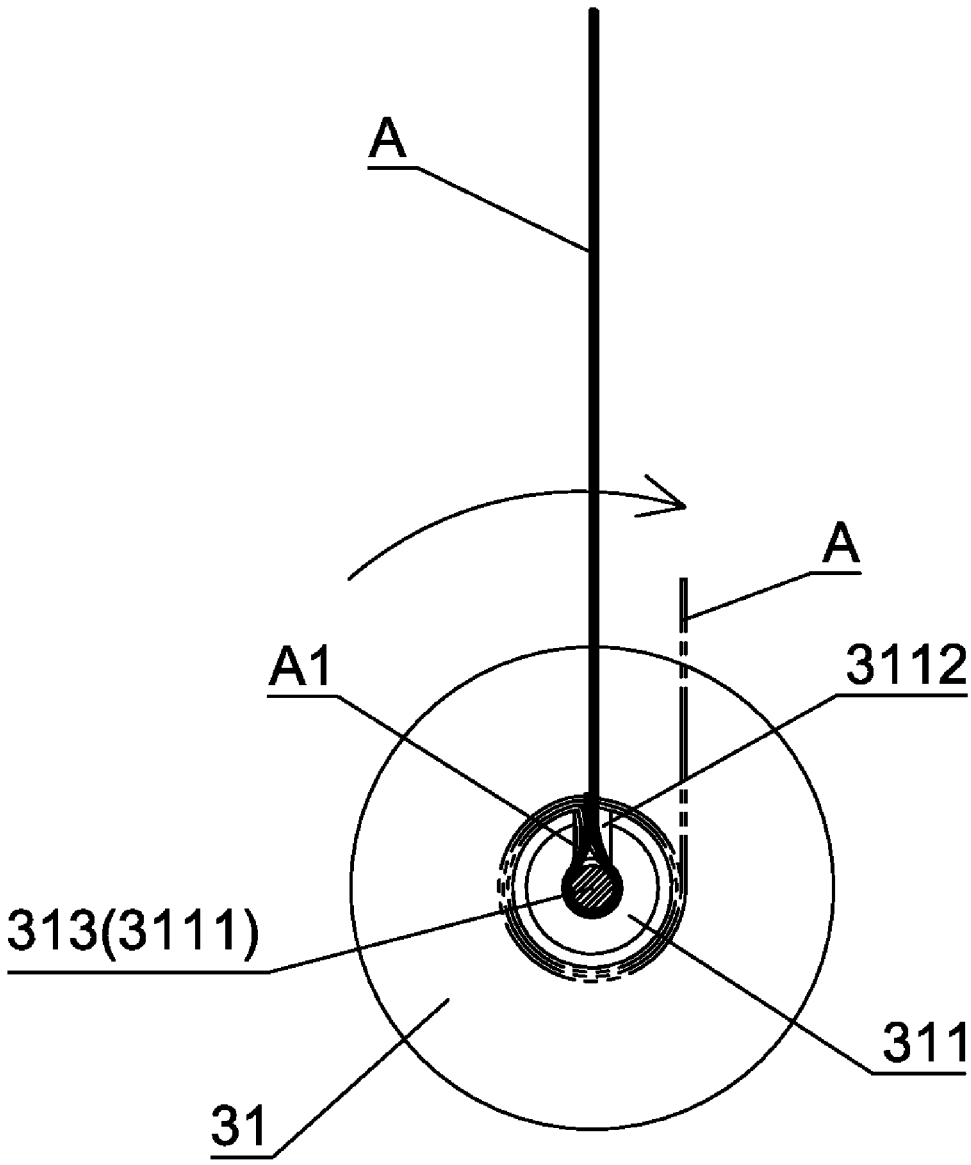
Fig. 4-A

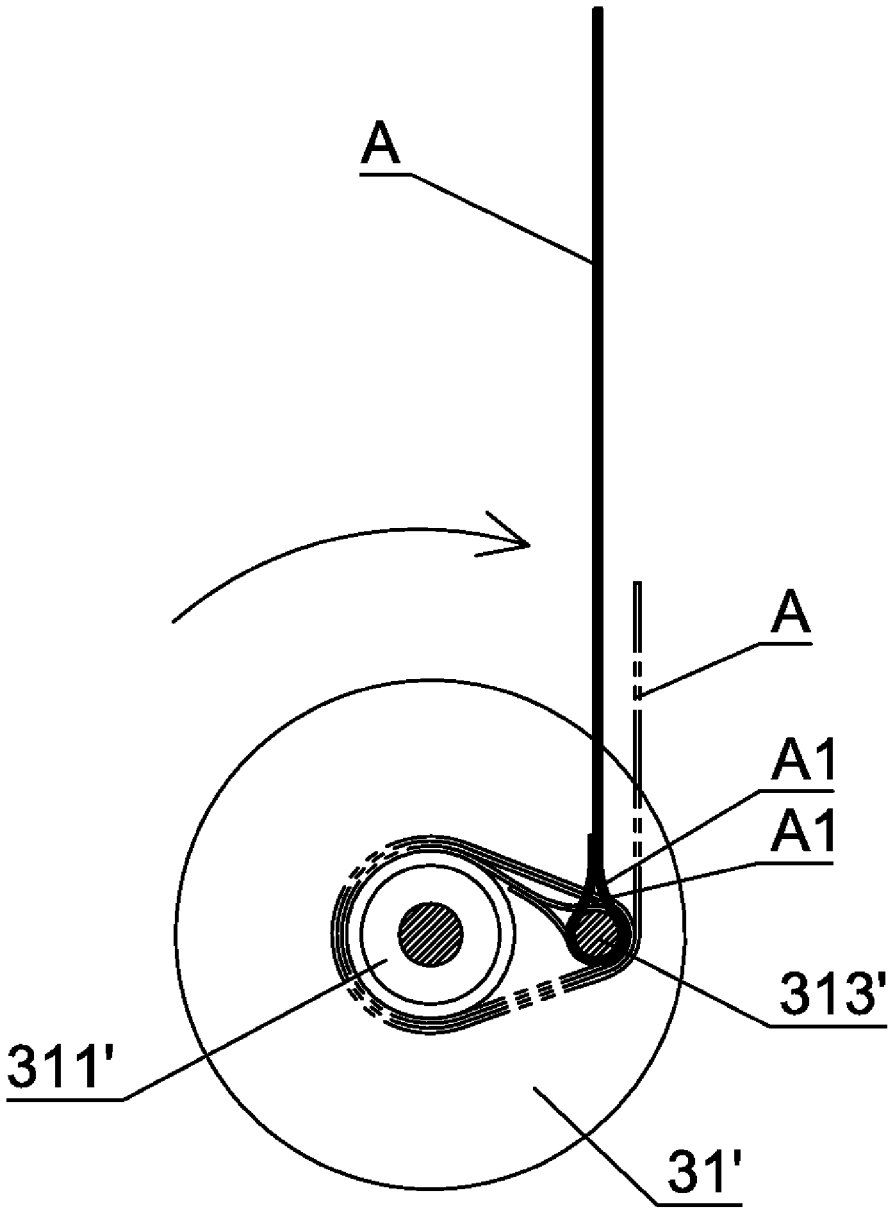
Fig. 5-A
PRIOR ART

REEL STRUCTURE FOR MARINE FABRIC TAPE

BACKGROUND OF THE INVENTION

1. Field of the Invention

The present invention relates to a reel structure for a marine fabric tape, and more particularly to one having a head portion in a water drop shape of the fabric tap to be positioned in an axle shaft of a gear tray for rolling up the fabric tap along with the axle shaft, providing an even applied force.

2. Description of the Prior Art

As shown in FIG. 5 and FIG. 5-A, a conventional reel structure for a marine fabric tape comprises a gear tray 31' having a central axle shaft 311' and an axle bolt 313' which is located apart from the axle shaft 311'. The axle bolt 313' is inserted through the gear tray 31' and a head portion A1 of a fabric tape A. The head portion A1 is in a water drop shape. With a handle of a windlass to turn the axle shaft, the gear tray 31' is driven to rotate. Because the head portion A1 of the fabric tape A is positioned on the axle bolt 313', the fabric tape A first wraps the axle shaft 311' and then the axle bolt 313' repeatedly to be in the from of a cam. This structure causes an uneven applied force and its operation is not smooth when the user turns the handle of the windlass. In addition, this structure bears different stress points, which may result in damage and looseness to short its service life.

SUMMARY OF THE INVENTION

According to the present invention, there is provided a reel structure for a marine fabric tape comprising an engaging seat and a reel device which is pivotally connected to the engaging seat; the engaging seat comprising a base, a stop plate, a positioning bolt, and a straight torsion spring, the base having two side boards formed with a pair of axle holes and a pair of rotation holes, one of the two side boards being formed with an aperture which is disposed in front of the rotation hole, the positioning bolt being inserted through a positioning hole of the stop plate and the aperture to be secured inside the engaging seat, the straight torsion spring being mounted on a lower portion of the stop plate, the stop plate having a stop portion; the reel device comprising a gear tray and a gear shaft, the gear tray including an axle shaft, a gear disc and an axle bolt, the axle bolt being inserted through a central pivotal hole of the gear tray and the pair of axle holes so that the gear tray being positioned between the pair of axle holes, the axle shaft being formed with a slot interconnected with the pivotal hole for insertion of a head portion of a fabric tape, the gear disc being disposed on the gear tray and located adjacent to the side board formed with the aperture to mesh with teeth of the gear shaft, the stop portion of the stop plate being adapted to engage with the teeth of the gear shaft, the gear shaft having two ends provided with left and right sleeves, a pad ring being provided on the gear shaft between the pair of rotation hole, the gear shaft being provided with a flat rod extending from the end which is located close to the aperture, the other end of the gear shaft being formed with a groove for insertion of a C-shaped ring to position the pad ring in place for rolling up the fabric tape evenly.

The head portion of the fabric tap is inserted through the slot into the pivotal hole, and the axle bolt is inserted through one of the pair of axle holes of the base, the pivotal hole of the gear tray, the head portion, and the other axle hole in sequence so that the gear tray is connected to the base. The gear disc meshes with the teeth of the gear shaft. The stop plate is urged by the straight torsion spring such that the stop portion engages with the teeth of the gear shaft to prevent a reverse rotation. When the handle of the windlass is rotated, the flat rod will be driven to rotate the gear shaft which then drives the gear disc tray to rotate. Because the head portion is positioned in the axle shaft, the fabric tape is rolled up along with the axle shaft to from a circular shape. The user can roll up the fabric tape repeatedly with the same force. The axle shaft functions as an axle center to roll up or to release the fabric tape in the form of a circle, thus its structure bears the same stress direction. It is not easy to have breakdown points in different directions which may cause looseness or damage. The present invention provides a longer service life.

BRIEF DESCRIPTION OF THE DRAWINGS

FIG. 3-A is a side cross-section view of the present invention;

FIG. 3-B is a rear end view of the present invention;

FIG. 4-A is a schematic view showing the operation of the gear tray of the present invention;

FIG. 5-A is a schematic view showing the operation of the conventional gear tray.

DETAILED DESCRIPTION OF THE PREFERRED EMBODIMENTS

Embodiments of the present invention will now be described, by way of example only, with reference to the accompanying drawings.

Figure 1:
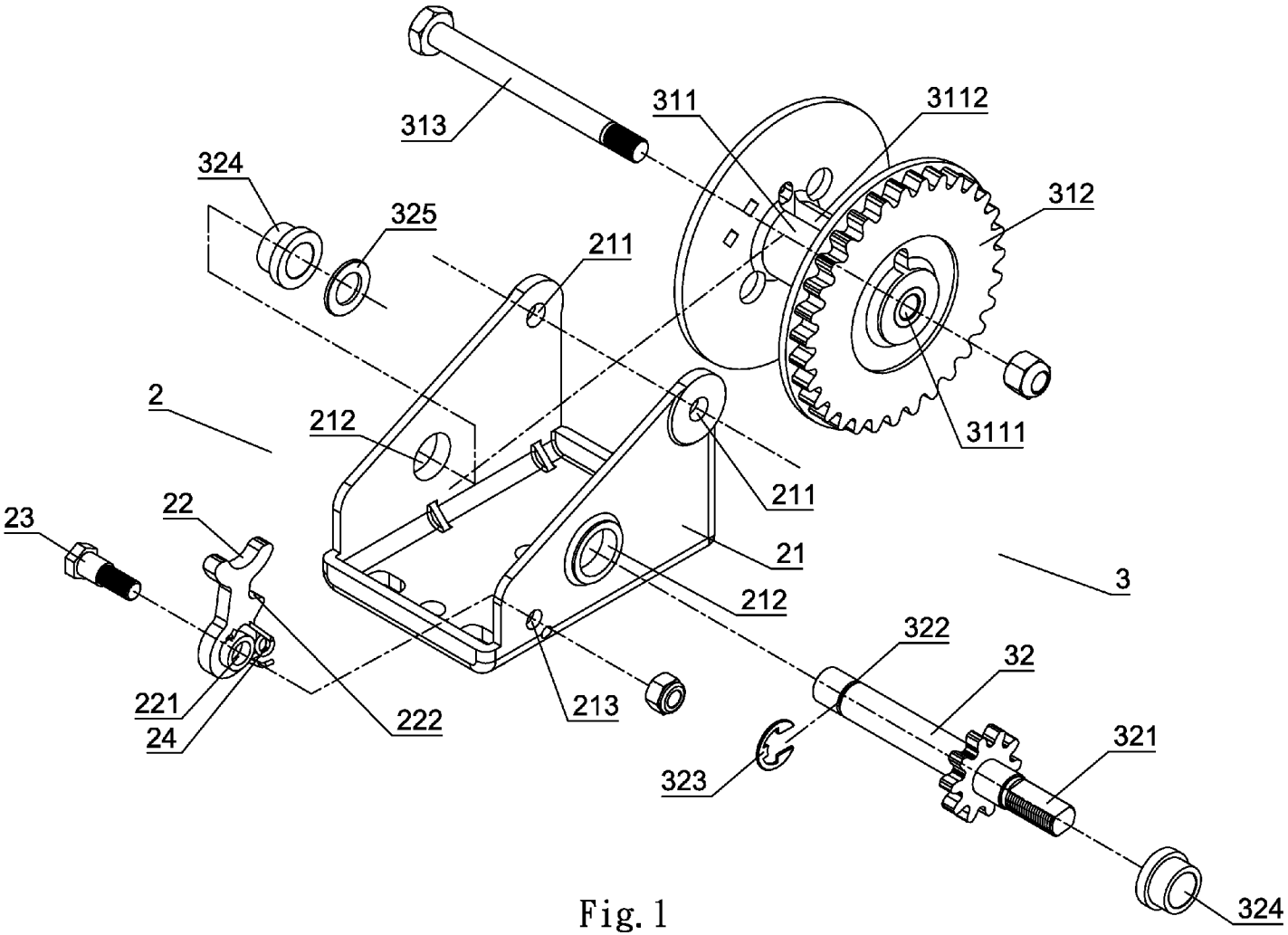
FIG. 1 is an exploded view of the present invention.
Figure 2:
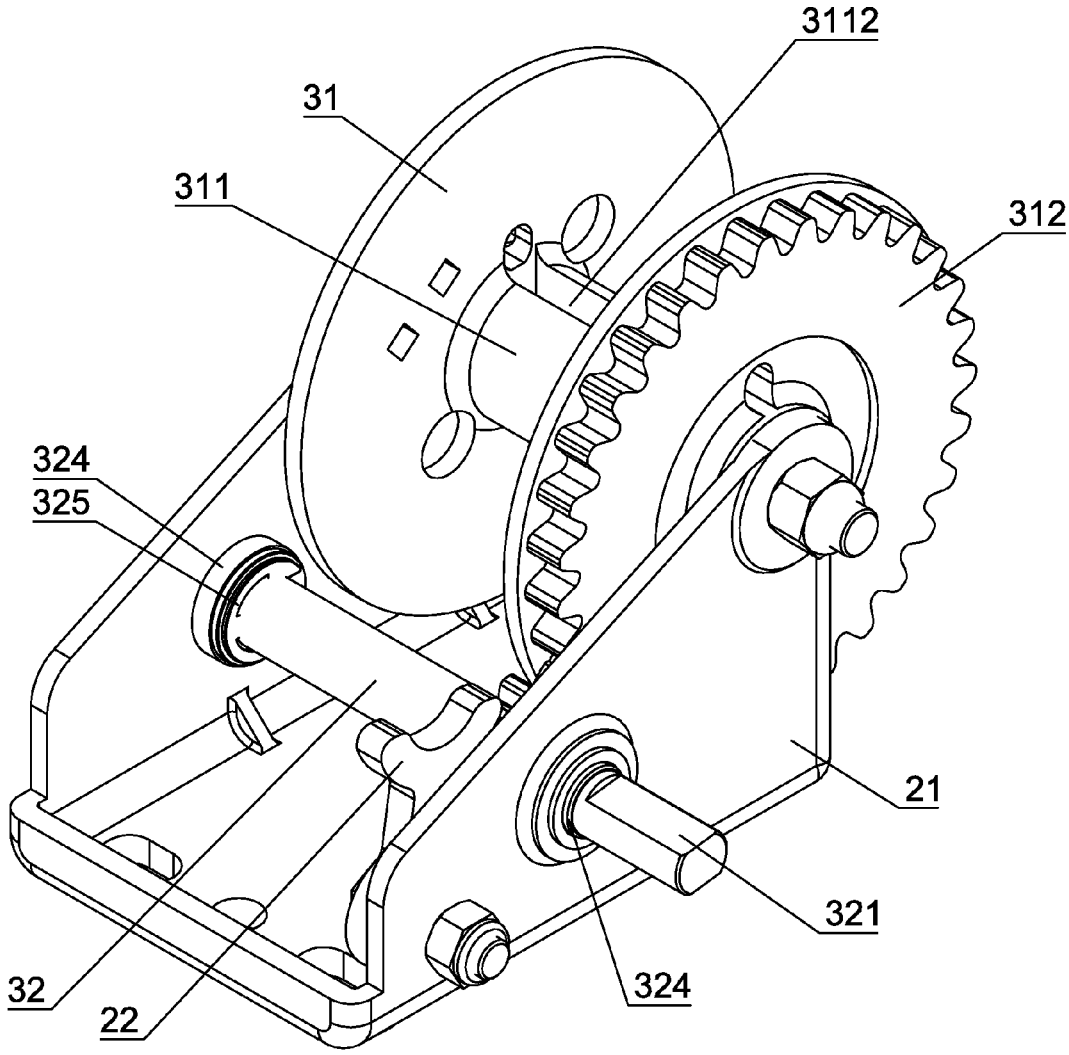
FIG. 2 is a perspective view of the present invention.

As shown in FIGS. 1 and 2, the present invention comprises an engaging seat 2 and a reel device 3 which is pivotally connected to the engaging seat 2.

The engaging seat 2 comprises a base 21, a stop plate 22, a positioning bolt 23, and a straight torsion spring 24. The base 21 has two side boards formed with a pair of axle holes 211 and a pair of rotation holes 212. One of the two side boards is formed with an aperture 213 which is disposed in front of the relative rotation hole 212. The positioning bolt 23 is inserted through a positioning hole 221 of the stop plate 22 and the aperture 213 to be secured inside the engaging seat 2. The straight torsion spring 24 is mounted on a lower portion of the stop plate 22 for a stop portion 222 of the stop plate 22 to engage with teeth of a gear shaft 32 so as to prevent disengagement due to a reverse rotation, providing a smooth operation to roll up the fabric tape.

The reel device 3 comprises a gear tray 31 and the gear shaft 32. The gear tray 31 includes an axle shaft 311, a gear disc 312 and an axle bolt 313. The axle bolt 313 is inserted through a central pivotal hole 3111 of the gear tray 31 and the pair of axle hole 212 so that the gear tray 31 is positioned between the pair of axle holes 211. The axle shaft 311 is formed with a slot 3112 interconnected with the pivotal hole 3111 for insertion of the head portion A1 of the fabric tape A. The head portion A1 is in a water drop shape. The gear disc 312 is disposed on the gear tray 31 and located adjacent to the side board formed with the aperture 213 to mesh with the teeth of the gear shaft 32. The gear shaft 32 has two ends provided with left and right sleeves 324. A pad ring 325 is provided on the gear shaft 32 between the pair of rotation hole 212. The gear shaft 32 is provided with a flat rod 321 extending from the end which is located close to the aperture 213.

The flat rod 321 is adapted to engage with a handle of a windlass. The other end of the gear shaft 32 is formed with a groove 322 for insertion of a C-shaped ring 323 so as to position the pad ring 325 in place for rolling up the fabric tape A evenly.

Figure 4:
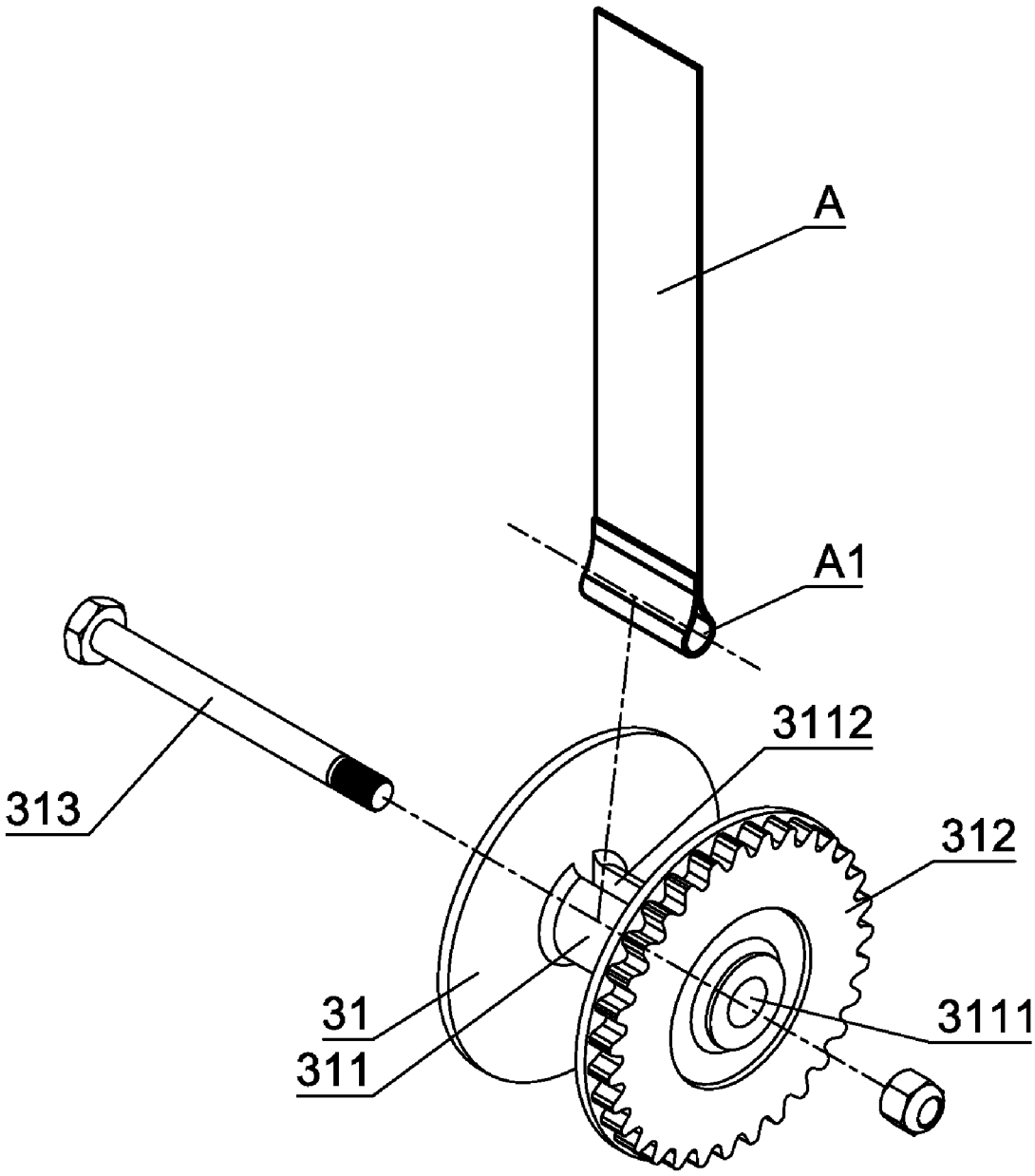
FIG. 4 is an exploded view of a gear tray of the present invention.
Figure 5:
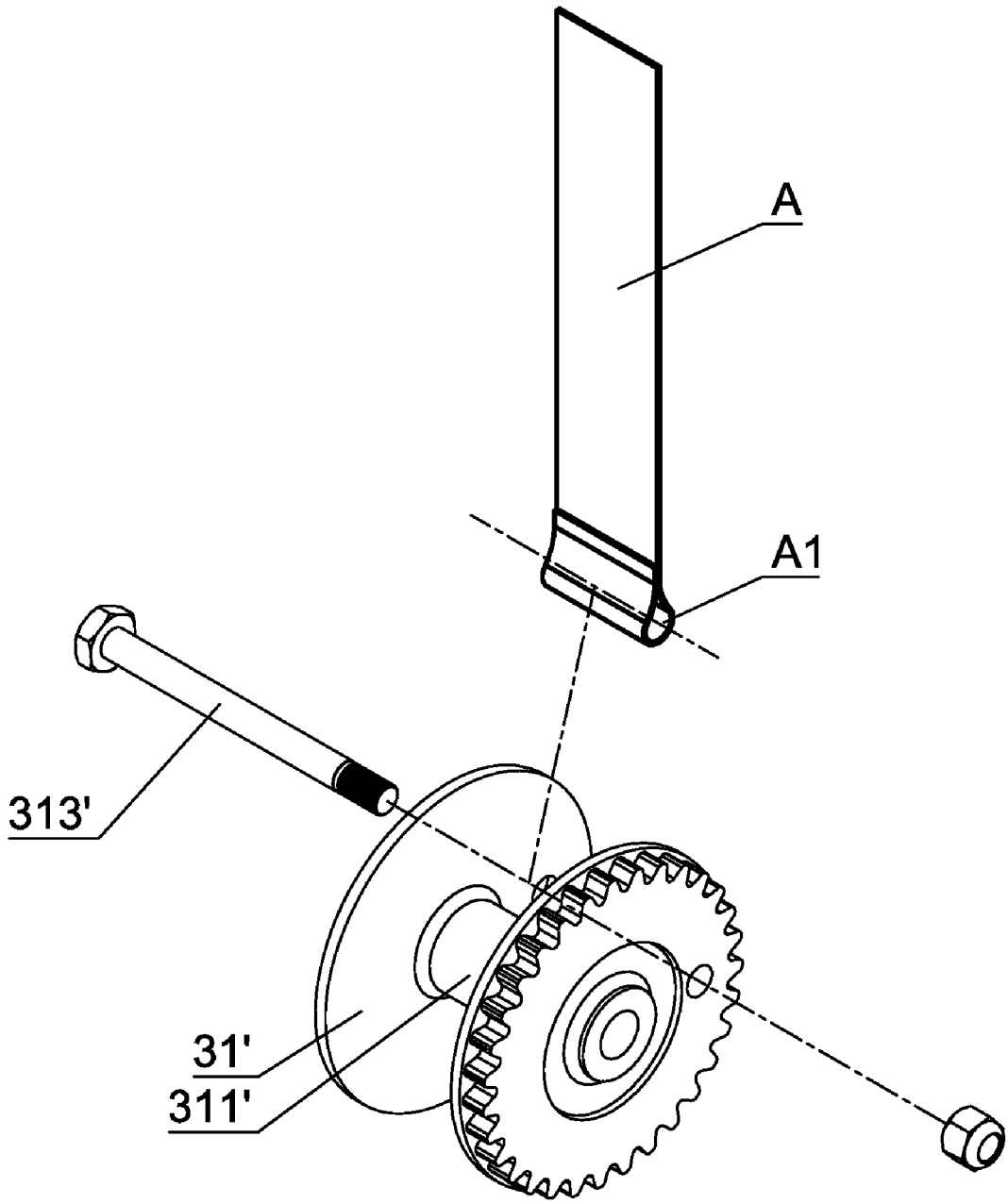
Fig. 5 PRIOR ART
FIG. 5 is an exploded view of a conventional gear tray and a fabric tape.

Referring to FIGS. 3-A-B, FIG. 4, FIG. 4-A, the head portion A1 of the fabric tap A is inserted through the slot 3112 into the pivotal hole 3111, and the axle bolt 313 is inserted through one of the pair of axle holes 211 of the base 21, the pivotal hole 3111 of the gear tray 31, the head portion A1, and the other axle hole 211 in sequence so that the gear tray 31 is connected to the base 21. The gear disc 312 meshes with the teeth of the gear shaft 32. The stop plate 22 is urged by the straight torsion spring 24 such that the stop portion 222 engages with the teeth of the gear shaft 32 to prevent a reverse rotation. When the handle of the windlass is turned, the flat rod 321 will be driven to rotate the gear shaft 32 which then drives the gear disc tray 31 to rotate. Because the head portion A1 is positioned in the axle shaft 311, the fabric tape A is rolled up along with the axle shaft 311 to from a circular shape, as shown in FIG. 4 and FIG. 4-A. The user can roll up the fabric tape A repeatedly with the same force. The axle shaft 311 functions as an axle center to roll up or to release the fabric tape A in the form of a circle, thus the structure bears the same stress direction. It is not easy to have breakdown points in different directions which may cause looseness or damage. The present invention provides a longer service life.

Accordingly, the present invention has the axle shaft 311 of the gear tray 31 as an axle center to roll up or to release the fabric tape A evenly for its structure to bear the same stress.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A reel structure for a marine fabric tape, comprising an engaging seat and a reel device which is pivotally connected to the engaging seat;

the engaging seat comprising a base, a stop plate, a positioning bolt, and a straight torsion spring, the base having two side boards formed with a pair of axle holes and a pair of rotation holes, one of the two side boards being formed with an aperture which is disposed in front of the rotation hole, the positioning bolt being inserted through a positioning hole of the stop plate and the aperture to be secured inside the engaging seat, the straight torsion spring being mounted on a lower portion of the stop plate, the stop plate having a stop portion;

the reel device comprising a gear tray and a gear shaft, the gear tray including an axle shaft, a gear disc and an axle bolt, the axle bolt being inserted through a central pivotal hole of the gear tray, a central hole of the axle shaft, a loop of a head portion of a fabric tape, and the pair of axle holes so that the gear tray being positioned between the pair of axle holes, the axle shaft being formed with a slot interconnected with the pivotal hole for insertion of the head portion of the fabric tape, the gear disc being disposed on the gear tray and located adjacent to the side board formed with the aperture to mesh with a plurality of teeth of the gear shaft, the stop portion of the stop plate being adapted to engage with the teeth of the gear shaft, the gear shaft having two ends provided with left and right sleeves, a pad ring being provided on the gear shaft between the pair of rotation holes, the gear shaft being provided with a flat rod extending from the end which is located close to the aperture, the other end of the gear shaft being formed with a groove for insertion of a C-shaped ring to position the pad ring in place for rolling up the fabric tape evenly;

thereby, the flat rod being driven to rotate the gear shaft by turning a handle of a windlass, the gear shaft driving the gear disc to rotate, the fabric tape being rolled up along with the axle shaft through rotation about the axle bolt both because the head portion of the fabric tape is positioned in the axle shaft and because the axle bolt also extends through the loop of the head portion of the fabric tape.

* * * * *